US007597588B1

(12) United States Patent
Hyzin et al.

(10) Patent No.: US 7,597,588 B1
(45) Date of Patent: Oct. 6, 2009

(54) COAX CONNECTOR WITH SPRING CONTACTS

(75) Inventors: Peter J. Hyzin, Coto de Caza, CA (US); Michael Santos Finona, Lake Forrest, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 12/154,266

(22) Filed: May 21, 2008

(51) Int. Cl.
*H01R 9/05* (2006.01)

(52) U.S. Cl. ..... 439/578

(58) Field of Classification Search ..... 439/578, 439/580, 581, 131, 219, 482
See application file for complete search history.

(56) References Cited

U.S. PATENT DOCUMENTS

| | | | | |
|---|---|---|---|---|
| 3,970,355 | A | 7/1976 | Pitschi | |
| 4,941,846 | A | 7/1990 | Guimond et al. | |
| 5,166,477 | A | 11/1992 | Perin, Jr. et al. | |
| 5,746,617 | A | 5/1998 | Porter, Jr. et al. | |
| 5,871,371 | A * | 2/1999 | Rothenberger et al. | 439/579 |
| 6,361,348 | B1 | 3/2002 | Hall et al. | |
| 6,508,672 | B1 | 1/2003 | Safai | |
| 6,685,492 | B2 * | 2/2004 | Winter et al. | 439/219 |
| 6,743,043 | B2 * | 6/2004 | Yamada | 439/482 |
| 6,758,680 | B2 * | 7/2004 | Duquerroy et al. | 439/63 |
| 6,796,813 | B1 * | 9/2004 | L'Hermet | 439/131 |
| 6,929,482 | B2 | 8/2005 | Benham | |
| 6,951,485 | B2 * | 10/2005 | Lin et al. | 439/607 |
| 7,097,460 | B2 * | 8/2006 | Clark et al. | 439/63 |

* cited by examiner

*Primary Examiner*—Chandrika Prasad
(74) *Attorney, Agent, or Firm*—Peter Van Winkle

(57) ABSTRACT

Coaxial contacts of a second connector (14) are in the form of static pads (34, 36), while coax contacts of a first connector (12) are in the form of spring contacts (40, 42) with pins (52) that engage the static pads. The first connector includes a coax center spring contact (40) positioned to engage a center static pad (34) of the second connector, and the first connector includes a plurality of outer coax spring contacts (42A, 42B, 42C, 42D) positioned to engage the outer static pad (36) of the second connector. When fully mated, a static pad region (90) on the first connector lies facewise adjacent to the outer static pad. The connectors are constructed to mate by pivoting the first connector against the second one, to assure that an outer coax spring contact makes engagement before the center spring contact makes engagement.

10 Claims, 2 Drawing Sheets

FIG. 1
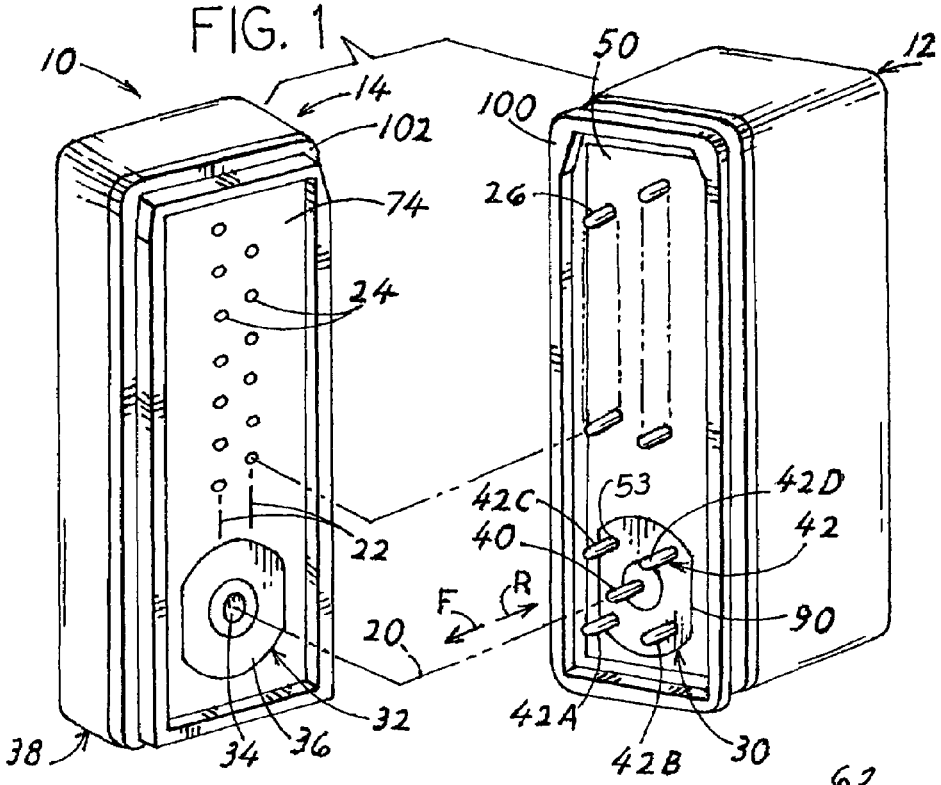
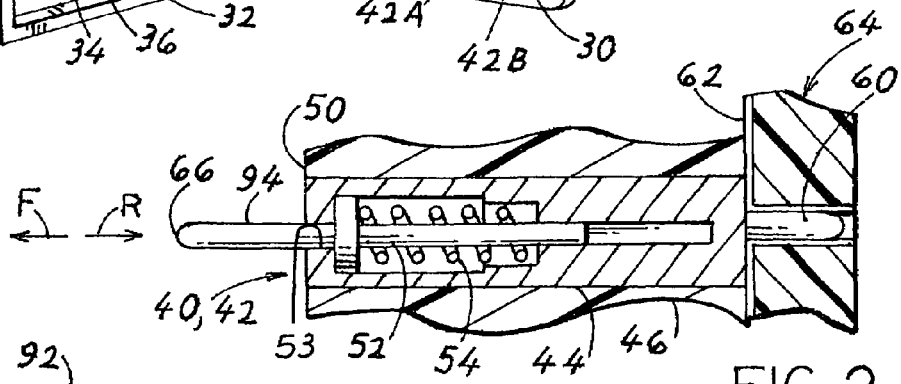
FIG. 2
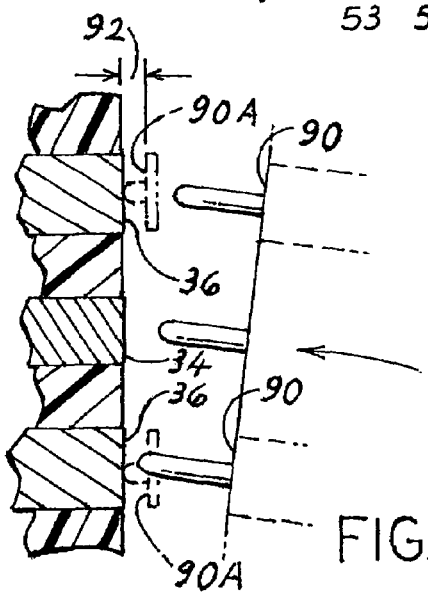
FIG. 3

COAX CONNECTOR WITH SPRING CONTACTS

BACKGROUND OF THE INVENTION

When a pair of connectors mate, the female contacts of one connector generally receive the male contacts of the other connector along a considerable mating distance. The mating distance can be reduced by the use of spring contacts such as shown in U.S. Pat. No. 6,758,682, wherein the second connector has static contact pads and the first connector has spring contacts. In a spring contact a pin projects forward from a plate but can be deflected rearward against a spring force when the pin engages a static contact pad. Where high frequency signals (above about one megahertz) are transmitted it is often desirable to use coaxial cables and coaxial connectors. A coaxial connector with a small mating distance (the distance from first contact engagement to final mating) would be desirable.

SUMMARY OF THE INVENTION

In accordance with one embodiment of the present invention, a coaxial connector assembly with first and second connectors is provided, that each have coax contacts that mate along a minimum distance of movement. The second connector has static coax center and outer contact pads that are fixed to the connector housing, and the first connector has coax spring contacts that engage the center and outer contact pads when the connectors are mated. Each spring contact includes a pin that is spring biased forward but that can be deflected rearward.

The first connector preferably has a plurality and preferably at least three, of the outer spring contacts that are positioned to engage the outer contact pad of the first connector, and all spring contacts project forward by the same distance. The connectors are mated by pivoting them together, so at least one of the outer spring contacts will engage the outer coax contact pad before the inner spring contact engages the inner coax contact pad. This assures that shielding provided by the constant voltage of the coax outer conductor will be established before signals pass through the coax inner conductor.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded isometric view of a connector assembly of the invention.

FIG. 2 is a sectional view of a portion of one of the connectors of FIG. 1, showing a spring contact with its rear terminated to a circuit board.

FIG. 3 is a partial sectional view of the second connector of FIG. 1, and showing spring contacts of the first connector as they approach and as they are fully mated to the second connector.

DESCRIPTION OF THE INVENTION

Figure 4:
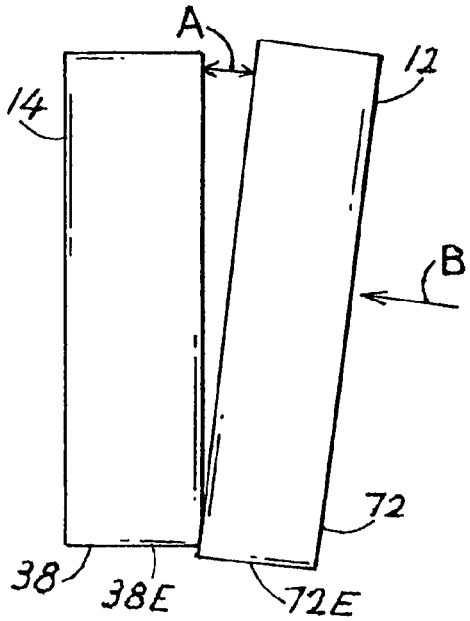
FIG. 4 is a simplified side elevation view of the connector assembly of FIG. 1, as the connectors are being mated.

FIG. 1 shows a connector assembly 10 of the present invention, which includes first and second connectors 12, 14 that are mate able by moving the first connector in a forward direction F along a coax axis 20 toward the second connector. The second connector includes rows 22 of contact pads 24, and the first connector has rows of spring contacts 26 that mate with the contact pads. The two connectors also have coaxial, or "coax" contact pairs 30, 32. The second connector coax contact pair 32 includes a center coax contact, or pad 34 that lies along axis 20 and an outer coax contact, or pad 36. The two conductive coax pads 34, 36 are static in that they do not move relative to the frame 38 of the second connector. The coax contacts and coax pads are parts of inner and outer coax conductors.

The first coax contact pair 30 includes spring contacts, including a center spring contact 40 that is intended to engage the center coax pad 34, and outer coax spring contacts 42 that are intended to engage the outer coax pad 36. FIG. 2 shows one construction of a spring contact 40, 42 which includes a spring contact frame 44 that lies in an insulative body 46 with a flat front face 50. The spring contact includes a pin 52 that slides forward and rearward F, R within the frame and that is biased forward by a compression spring 54. A rear end of the contact forms a terminal 60 that terminates to a trace 62 on a circuit board 64. The pin has a rounded front end 66 that will engage a contact pad. The engagement is by the end 66 pressing along the axis against the pad, without sliding engagement. The center spring contact 40 and outer spring contacts 42 are preferably of the same construction, and both project forward by the same distance. This avoids the need for extra-long spring contacts that are more likely to be damaged and that increase the length along which mating occurs.

The first connector of FIG. 1 has four outer spring contacts 42A, 42B, 42C, and 42D that are uniformly angularly spaced by angle K (FIG. 6) about the axis 20, and that are positioned to engage four locations on the coax outer pad 36. The use of a plurality of spring contacts increases reliability of contacting, and also can assure that the coax outer contacts 36, 42 engage each other before the coax inner contacts engage each other. Each contact subtends an angle J (FIG. 6) of less than 180°, and actually less than 30°, about the axis 20. The coax outer contacts of a coaxial connector assembly are usually grounded, and it is desirable that such grounded contacts engage before engagement of the signal-carrying contacts that are usually formed by the coax inner contacts. This assures that shielding provided by the outer coax conductor, is established before inner contact and pad engagement occurs that allows signals to pass through the inner conductor. In the prior art this often was accomplished by having the outer contact extend forward of the inner contact, which added to the distance along which mating occurred. In the present invention this is accomplished by pivoting the second connector relative to the first one during mating, as described below.

Figure 5:
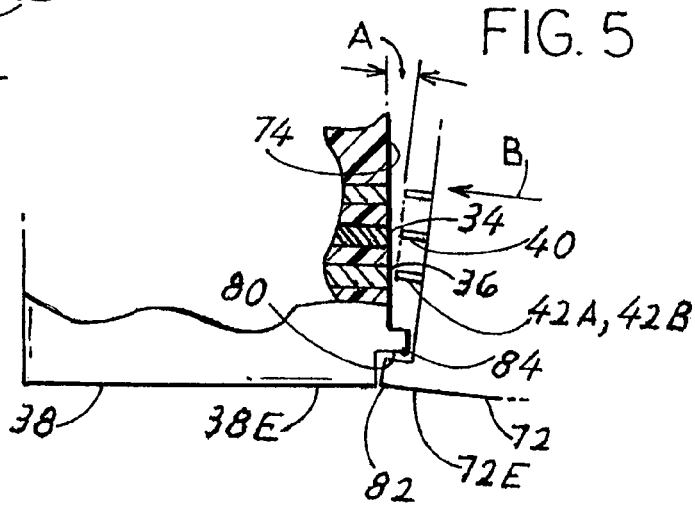
FIG. 5 is a partial sectional view of a portion of FIG. 4.

FIG. 5 shows that the second connector has a frame 38 with a lower end 38E that is designed to receive the lower front end 72E of the frame 72 of the first connector, while the first connector is inclined by an angle A of about 7° from the vertical (while the second frame front face 74 is vertical). FIG. 5 shows that the second connector and second frame lower ends 38E form a recess 80 and the bottom of the first frame front end and first connector front end 72E has a projection 82 that can fit into and pivot about axis 84 on the walls of the recess to complete the mating of the connectors. It is easier to align the bottom end of the two connectors than to try to simultaneously align the top and bottom of the two connectors. Of course, the connectors also can be mated by moving the first connector forward F along the axis 20.

As the first connector pivots in the direction B of FIG. 5, the two bottommost spring contacts 42A, 42B engage the coax outer contact pad 36 before the center spring contact 40 engages the coax center pad 34. It is desirable to provide a plurality of outer spring contacts, preferably at least three spring contacts and more preferably at least four of them. This assures that at least one of the outer contacts will engage the coax outer pad before the center spring contact engages the coax center pad, regardless of the direction of tilt of the first connector relative to the second one.

FIG. 1 shows that the coax outer spring contacts 42 project from a static conductive outer pad region 90 of the first connector. The outer pad region 90 has the same shape and size as the second connector outer coax pad 36. FIG. 3 shows the coax outer contact pad 36 of the second connector, and the static outer pad region 90 of the first connector when the connectors are being mated and can be moved further together, and at 90A when they are fully mated and the frames of the two connectors prevent any further movement together. In the fully mated position, the first connector outer pad region lies at 90A, where it lies facewise adjacent (parallel and close) to the first connector outer pad 36. There is a gap 92 between them, but the gap is very short so it has a minimal effect on the transmission of a high frequency signal though the two connectors.

Figure 6:
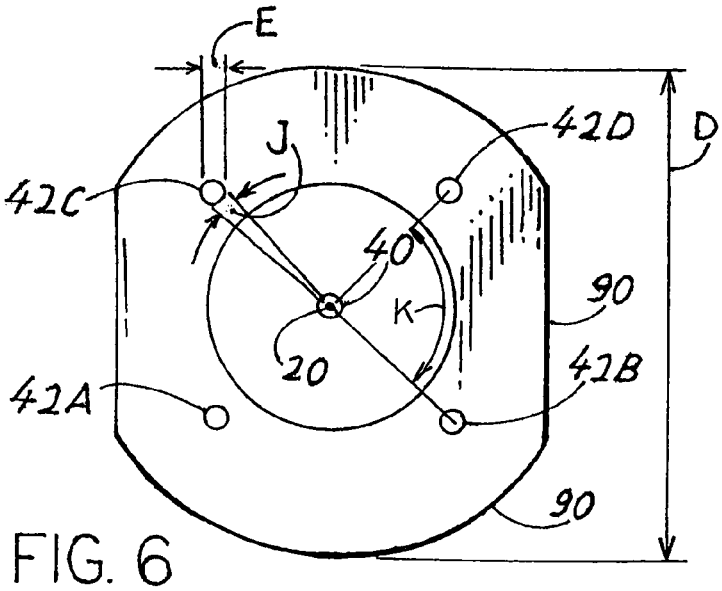
FIG. 6 is a front elevation view of a portion of the first connector of FIG. 1.

Applicant has constructed and successfully tested connectors of the construction shown in the figures. As shown in FIG. 6, the static outer pad region 90 had a maximum diameter D of 7 millimeters, which was the same as the diameter of the coax outer contact pad 36, and each pad extended 360° about the axis 20. The four spring contacts, which each extends less than 180° about the axis and actually subtends an angle J of less than 30° about the axis, were uniformly angularly spaced by angles (k) of 90° about the axis 20. Each of the spring contacts had an exposed pin end 94 of a diameter E of 0.5 mm that projected through a hole 53 (FIG. 2) of a frame, and an initial exposed length of about 3 mm. When the connectors were fully mated, with frame faces 100, 102 (FIG. 1) engaged, the spring contacts had been compressed by 2 mm. The gap 92 (FIG. 3) between outer pad 36 and first connector pad region 92 then was only about one mm. It is preferred that the gap length be no more than 2 mm.

Thus, the invention provides a connector assembly with at least one coaxial contact pair in each connector, that has a small mating length and that assures good coax connections. A second of the coax pads that lies on the second connector, includes static center and outer pads. A first of the coax pairs that lies on the first connector, includes a center spring contact and at least one, and preferably at least three outer spring contacts that engage the second static pads. The first connector also includes a static pad region through which the outer spring contacts project, that lies close to (no more than two mm from) the static second connector outer contact pad. The frames of the two connectors are constructed to allow them to mate by placing the bottom ends of the two connectors against each other, with the first connector inclined from the vertical, and then pivoting the connectors so their front faces are parallel and adjacent (within two mm).

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coax connector assembly that includes first and second mateable connectors that each includes center and outer coax contacts, wherein:

said second connector has coax center and outer pads (34, 36) with said center pad lying along a coax axis (20) and said outer pad spaced radially from said axis;

said first connector is moveable primarily forward along said axis towards said second connector to mate said connectors;

said first connector has a plurality of spring contacts with front tips (66) that are each deflectable rearwardly, including at least one coax center spring contact (40) positioned to press against said second connector coax center pad, and including a plurality of outer spring contacts (42A, 42B, 42C, 42D) that are individually spring biased forwardly (F) to press their front tips against said second connector coax outer pad, said outer spring contacts each extending less than 180° around said axis and with said outer spring contacts being angularly spaced apart (k) around said axis.

2. The connector described in claim 1 wherein:

said connectors each have top and bottom ends; and wherein:

said first connector has a front (50) with holes (53) and said spring contacts have front portions (94) that project through said holes;

said at least one coax center spring contact (40) and said coax outer spring contacts (42A, 42B, 42C, 42D) are of the same lengths, with at least one of outer spring contacts (42A, 42B) lying closer to said first connector bottom end (72E) than does said center spring contact;

said first connector is mateable to said second connector by pivoting one on the other about an axis (84) lying below said center and outer coax spring contacts.

3. The connector assembly described in claim 1 wherein:

said first connector has an outer pad region (90) that surrounds and is spaced radially outward of said center spring contact and that has holes (53) through which said outer spring contacts extend, said outer pad region (90) lying facewise adjacent to said outer pad (36) on said second connector when said connectors are fully mated.

4. The connector assembly described in claim 1 wherein:

each of said forwardly biased outer spring contacts has a moveable pin (52) that subtends an angle (J) of less than 30° about said axis.

5. The connector assembly described in claim 1 wherein:

said first and second connectors have frames with lower ends (72E, 38E) that are pivotally engageable to allow the first connector to pivot about the frame lower ends about an axis (84) extending perpendicular to said forward direction to engage said center and outer spring contacts with said coax center and outer pads.

6. A coax connector assembly that includes first and second mateable connectors that each has center and outer coax contacts, with the coax contacts of said second connector being in the form of static contact pads (34, 36) including a coax center pad (34) lying along an axis (20) and a coax outer pad (36) that is radially spaced from said axis, wherein:

said first connector is moveable in a forward direction (F) that is parallel to said axis toward said second connector to mate said connectors;

said first connector has a plurality of spring contacts (40, 42) with front tips (66) that are each independently deflectable rearwardly (R), including a coax center spring contact (40) and a plurality of coax outer spring contacts (42A, 42B, 42C, 42D) positioned to respectively engage said center pad (34) and to engage said outer coax pad (36), as said connectors mate, said plurality of outer spring contacts being angularly spaced (K) about said axis.

7. The connector assembly described in claim 6 and wherein said first connector has a static first connector coax pad (90) from which said spring contact front ends (94) project wherein:

said coax center and outer spring contacts (40, 42A, 42B, 42C, 42D) have front ends that project the same distances forward of said static pad;

said plurality of coax outer spring contacts on said first connector comprises at least three spring contacts that are angularly spaced about said axis, so at any tilt (A) of said connectors relative to one another during connector mating, one of said outer spring contacts (42A, 42B) will engage said coax outer pad before said coax center spring contact (40) engages said coax center pad.

8. The connector assembly described in claim 6 wherein:

said coax outer spring contacts of said first connector, each has a front end that subtends an angle (J) of less than 30° about said axis.

9. The connector described in claim 6 wherein:

said coax outer pad (36) of said second connector extends completely around said center pad;

said first connector has an outer static contact pad region (90) with holes (53) through which said coax outer spring contacts extend, with said coax outer pad (36) of said second connector and said contact pad region (90) of said first connector lying facewise adjacent when said connectors mate.

10. A coax connector assembly that includes first and second mateable connectors that each includes center and outer coax contacts, wherein:

said second connector has conductive coax center and outer pads with said center pad (34) lying along a coax axis (20) and said outer pad (36) being flat and spaced radially from said axis;

said first connector is moveable primarily forward (F) along said axis towards said second connector to mate said connectors;

said first connector has a plurality of spring contacts with front tips (66) that are each deflectable rearwardly, including at least one coax center spring contact (40) positioned to press against said second connector coax center pad, and at least one coax outer spring contact (42A, 42B, 42C, 42D) positioned to press against said second connector coax outer pad (36), said at least one outer spring contact extending less than 180° around said axis;

said first connector has a flat conductive outer pad region (90) with at least one hole (53) through which said at least one coax outer spring contact projects;

when said first and second connectors are mated, said second connector outer pad (36) and said first connector outer pad region (90) lie facewise adjacent to each other with any gap (92) between them being no more than 2 millimeters long.

* * * * *